United States Patent [19]

Misumi et al.

[11] Patent Number: 4,518,671

[45] Date of Patent: May 21, 1985

[54] ELECTROPHOTOGRAPHIC PHOTOSENSITIVE Se OR Se ALLOY DOPED WITH OXYGEN

[75] Inventors: Teruo Misumi, Kawasaki; Yoichi Osato, Yokohama, both of Japan

[73] Assignee: Canon Kabushiki Kaisha, Tokyo, Japan

[21] Appl. No.: 533,623

[22] Filed: Sep. 19, 1983

Related U.S. Application Data

[63] Continuation of Ser. No. 416,213, Sep. 9, 1982, abandoned.

[30] Foreign Application Priority Data

Oct. 7, 1981 [JP] Japan ..... 56-159952

[51] Int. Cl.[3] ..... G03G 5/082; G03G 5/09; G03G 5/14

[52] U.S. Cl. ..... 430/84; 430/57; 430/58; 430/67; 430/95

[58] Field of Search ..... 430/57, 58, 67, 84, 430/95

[56] References Cited

U.S. PATENT DOCUMENTS

| | | | |
|---|---|---|---|
| 3,077,386 | 2/1963 | Blakley et al. | 430/84 X |
| 3,685,989 | 8/1972 | Galer | 430/95 X |
| 4,370,399 | 1/1983 | Ghesh et al. | 430/95 X |

FOREIGN PATENT DOCUMENTS

| | | | |
|---|---|---|---|
| 54-9931 | 1/1979 | Japan . | |
| 57-45551 | 3/1982 | Japan | 430/95 |
| 619026 | 3/1979 | U.S.S.R. | 430/95 |

*Primary Examiner*—Roland E. Martin

*Attorney, Agent, or Firm*—Fitzpatrick, Cella, Harper & Scinto

[57] ABSTRACT

An electrophotographic photosensitive member has a selenium type photoconductive layer containing 8000 ppm or less oxygen based on selenium. The member is free from a fatigue due to repeated use.

3 Claims, 6 Drawing Figures

ELECTROPHOTOGRAPHIC PHOTOSENSITIVE Se OR Se ALLOY DOPED WITH OXYGEN

This application is a continuation of application Ser. No. 416,213, filed Sept. 9, 1982, now abandoned.

BACKGROUND OF THE INVENTION

1. Field of the Invention

This invention relates to an electrophotographic photosensitive member, and more particularly to an electrophotographic photosensitive member of selenium type comprising selenium containing oxygen.

2. Description of the Prior Art

Construction of an electrophotographic photosensitive member varies depending upon the desired characteristics or the type of the desired electrophotographic process, but in all cases the electric charge of electron-hole pairs caused by injection of electromagnetic waves is drifted under an electric field, and the performance of electrophotographic photosensitive member largely depends on the photoconductive layer.

In case of photosensitive members having an insulating layer on the surface of the photoconductive layer, electrostatic images are formed on the surface of the insulating layer, and therefore, it is necessary that electric charges are injected to the interface between the insulating layer and the photoconductive layer.

An example of electrophotographic processes applicable to such photosensitive members as above comprises a primary charging, an imagewise exposure simultaneously with AC discharging or charging in a polarity opposite to the polarity of the primary charging, or the AC discharging or the charging being effected after an imagewise exposure, and a blanket exposure.

When the photoconductive layer is composed of a p-type semiconductor, such as Se, SeTe and the like, the primary charging is carried out by a negative corona discharging to inject positive charges into the photoconductive layer from the support resulting in transferring the charges to the interface between the insulating layer and the photoconductive layer by the electric field applied to the photoconductive layer. When it is difficult to inject electric charges from a support, the photosensitive member is uniformly irradiated from the support side with a light immediately before or simultaneously with a negative corona discharging so as to form a proper amount of positive charge at the interface between the insulating layer and the photoconductive layer. When the light irradiation is effected from the support side, the support should be composed of a light transmissive material such as Nesa glass, transparent resin films and the like.

In case of photosensitive members which do not have an insulating layer on the photoconductive layer, it is not necessary to inject electric charges upon the primary charging. A typical process therefor where a p-type semiconductor is employed comprises applying an electric field to the photoconductive layer by a primary charging with a positive corona discharging and transferring positive charges formed by imagewise exposure to the support side.

Heretofore, Se-type photoconductive layers have been known to be of high sensitivity and high mechanical strength which may be produced by vapor-deposition of Se or Se containing As, Te, Sb or the like, but have some drawbacks to be solved. One of the drawbacks is a fatigue due to repeating.

When a photosensitive member is used repeatedly, the difference in potential between a dark portion and a light portion of an electrostatic image becomes smaller than that at the beginning, and therefore, it is observed that the contrast is lowered. This is due to so-called fatigue of photosensitive members. It seems that electric charges are trapped in a photoconductive member due to electric defects in the photoconductive layer and become space charges. This phenomenon is increased as the photosensitive member is used repeatedly. As a result, the residual potential increases and the potential at dark portions decreases.

For the purpose of producing electrostatic images of high contrast with good reproducibility, a photoconductive layer free from the fatigue due to repeating is indispensable.

SUMMARY OF THE INVENTION

An object of the present invention is to provide an electrophotographic photosensitive member free from a fatigue due to repeating.

Another object of the present invention is to provide an electrophotographic photosensitive member having a high charge acceptance and free from a fatigue due to repeating.

A further object of the present invention is to provide an electrophotographic photosensitive member having high sensitivity and free from a fatigue due to repeating.

According to the present invention, there is provided an electrophotographic photosensitive member which comprises a selenium type photoconductive layer containing oxygen in an amount of 8000 ppm or less based on selenium.

DESCRIPTION OF THE PREFERRED EMBODIMENTS

The photoconductive layer according to the present invention contains oxygen as an impurity so that transport of electric charges is good and electrical defects can be compensated by which positive charges are trapped in the photoconductive layer when the positive charges drift in the photoconductive layer and a residual potential is formed and a potential at a dark portion is lowered. As a result, electrophotographic photosensitive members free from a fatigue due to repeating can be obtained.

Therefore, the photosensitive member is particularly useful as a high speed copying photosensitive member, for example, as a photosensitive member used for a high speed copying where one and the same portion of the photosensitive member is repeatedly subjected to an electrophotographic process at an interval of 2 sec. or less.

Figure 1:
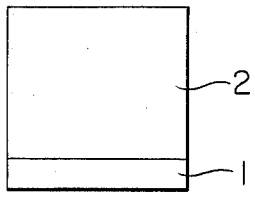
FIG. 1, and FIG. 2 and FIG. 3 are cross sectional views of embodiments according to the present invnetion.
Figure 2:
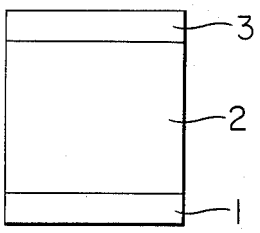
Figure 3:
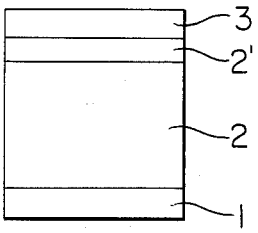

Typical examples of the electrophotographic photosensitive member of the present invention are illustrated in FIGS. 1, 2 and 3.

The photosensitive member in FIG. 1 is composed of a support 1 and a photoconductive layer 2. The photosensitive member in FIG. 2 is composed of a support 1, a photoconductive layer 2 and an insulating layer 3 disposed on the photoconductive layer.

The photosensitive member in FIG. 3 is composed of a support 1, a photoconductive layer 2, another photoconductive layer 2' whose sensitivity is higher than that of photoconductive layer 2, and an insulating layer 3.

The photoconductive layer 2' of high sensitivity effectively absorbs a light energy upon imagewise exposure to generate a large quantity of electric charge resulting in giving a highly sensitive photosensitive member while the photoconductive layer 2' disadvantageously increases the fatigue due to repeating. However, such disadvantageous fatigue due to repeating can be prevented by using a selenium type photoconductive layer containing oxygen as a material for the photoconductive layer 2. In FIG. 3, insulating layer 3 may be omitted, if desired.

According to the present invention, the oxygen contained in the photoconductive layer serves to compensate electric defects which cause to trap electric charges injected from the support and electric charges formed by imagewise exposure in the photoconductive layer when these charges drift in the photoconductive layer.

The amount of oxygen contained in the photoconductive layer is usually 20–8000 ppm, preferably 100–4000 ppm, more preferably 500–3000 ppm based on selenium.

When the oxygen amount increases too much, the dark resistance of the photoconductive layer decreases. Therefore, for the purpose of obtaining a sufficient charge acceptance, the amount of oxygen is 8000 ppm or less.

Thickness of the photoconductive layer may be appropriately determined depending upon the electrophotographic process used. The thickness is usually 5–100 microns, preferably 10–80 microns.

As materials for forming the selenium type photoconductive layer, there may be mentioned selenium and a selenium containing at least one member selected from Te, As, Sb, and Bi.

As the support, there may be used metals such as Al, Ni, brass, Cu, Ag and the like, electroconductive glass, resins such as polyesters, polyethylene and the like, paper, glass, ceramics and the like.

The insulating layer is usually composed of resins. Typical resins therefor are polyesters, polyparaxylylenes, polyurethanes, polycarbonates, polystyrenes and the like.

Materials for the photoconductive layer 2' in FIG. 3 having a sensitivity higher than that of photoconductive layer 2 may be optionally selected depending upon the electrophotographic process applied, and the material may be, for example, ZnO, CdS, polyvinylcarbazoles, and selenium type materials. In particular, typical selenium type materials are Se-Te, Se-Sb, Se-Bi, Se-As and other selenium alloys.

Thickness of the photoconductive layer 2' having a higher sensitivity is usually 1–15 microns, preferably 1–5 microns.

EXAMPLE 1

Figure 4:
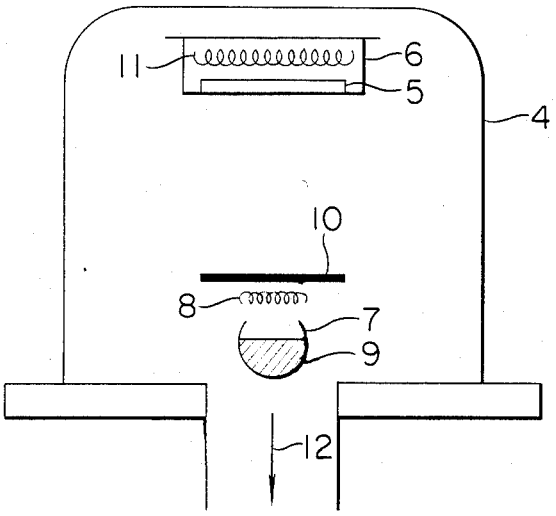
FIG. 4 is a vapor-deposition apparatus which can be used for producing a photosensitive member according to the present invention.

As shown in FIG. 4, an aluminum substrate (100 mm × 100 mm) 5 was placed at a predetermined position in a vapor-deposition vessel 4. Substrate 5 was at a distance of about 10 mm from a heater 11 for heating it and fixed to a fixing member 6. 70 g. of selenium powders of 99.999% purity (five-nine purity) 9 doped with 1000 ppm of oxygen was charged in a vapor-deposition boat of quartz 7. A tungsten spiral heater 8 was disposed over vapor-deposition boat 7 and air in vapor-deposition vessel 4 was evacuated as shown by the arrow 12 to bring the pressure to about $5\times10^{-5}$ Torr. Then, substrate 5 was heated to 60° C. by heater 11 and kept at that temperature.

Figure 5:
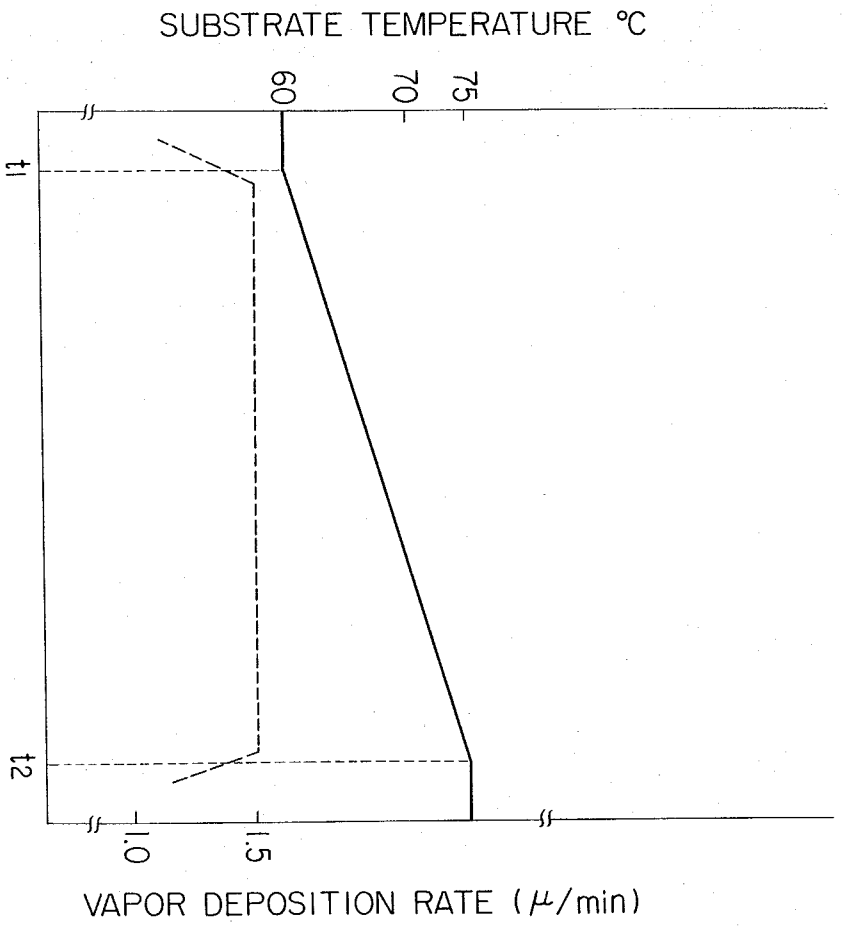
FIG. 5 is a graph showing a vapor-deposition procedure for forming a photoconductive layer according to the present invention.

Referring to FIG. 5, changes of the substrate temperature and vapor-deposition rate during vapor-deposition are explained below.

Temperature of vapor-deposition boat 7 was raised to 300° C. by spiral heater 8 over vapor-deposition boat 7 to melt the selenium doped with 1000 ppm oxygen. As illustrated in FIG. 5, a shutter 10 was opened at a point $t_1$ when the selenium doped with 1000 ppm oxygen was uniformly melted to start vapor-deposition on substrate 5, and the vapor-deposition was continued until all the selenium doped with oxygen in the boat 7 disappeared. Spiral heater 8 was switched-off at a point $t_2$ when the selenium in the boat 7 disappeared and shutter 10 was closed to end the vapor-deposition. The thickness of the resulting photoconductive layer was 60 microns.

The resulting photosensitive member was evaluated with respect to fatigue due to repeating by the following procedure.

A positive corona discharging with source voltage of ⊕ 6 KV was applied to the photosensitive member to charge to a surface potential of 600 V immediately followed by a blanket exposure to the photosensitive member and then discharging was effected by AC corona discharging.

The above procedure was repeated 100 times at a cycle of 2 sec. The surface potential did not change at the first time to the hundredth time as shown by the straight line A of FIG. 6, and any fatigue due to repeating was not observed.

Further, a polyurethane resin was coated on the surface of the photosensitive member as an insulating layer in the thickness of 25 microns. The following measurement was conducted.

A negative corona discharging of ⊖ 6 KV was effected to charge the surface of the photosensitive member to ⊕ 2000 V. As a secondary charging, a positive corona discharging of ⊕ 6 KV was conducted to discharge the surface of the insulating layer, and then, the surface was uniformly subjected to a blanket exposure resulting in a surface potential of ⊖ 800 V. Such procedure was repeated at a cycle of 2 sec., and as shown by the line B in FIG. 6, the surface potential after a blanket exposure from the first time to the hundredth time does not change and any fatigue due to repeating was not observed.

COMPARATIVE EXAMPLE 1

Repeating the procedure of Example 1 except that selenium of 99.999% in purity was vapor-deposited in place of selenium doped with 1000 ppm of oxygen, there was obtained a photosensitive member. Then, a positive corona discharging of ⊕ 6 KV was applied to the photosensitive member to charge to a surface potential of ⊕ 600 V immediately followed by a blanket exposure to the photosensitive member, and further discharging was effected by AC corona discharging. The above procedure was repeated 100 times at a cycle of 2 sec. The surface potential after the blanket exposure gradually increased with the number of times of repeating, and reached 200 V at the 100th time to reveal a fatigue due to repeating as shown by a curve C in FIG. 6.

Further a polyurethane resin was coated on the surface of the photosensitive member as an insulating layer in the thickness of 25 microns, and the following measurement was effected.

The surface of the resulting photosensitive member was charged to ⊖ 2000 V by a negative corona discharging of ⊖ 6 KV, and the surface of the insulating layer was discharged by a positive corona discharging of ⊕ 6 KV as a secondary charging, and then a blanket exposure was conducted uniformly resulting in a surface potential of ⊖ 750 V.

The above procedure was repeated at a cycle of 4 sec. and measurement was effected. The surface potential after a blanket exposure gradually decreased with the number of times repeating and the surface potential at the 100th time was 650 V and a fatigue due to repeating occurred, as shown by a curve D of FIG. 6.

EXAMPLE 2

Figure 6:
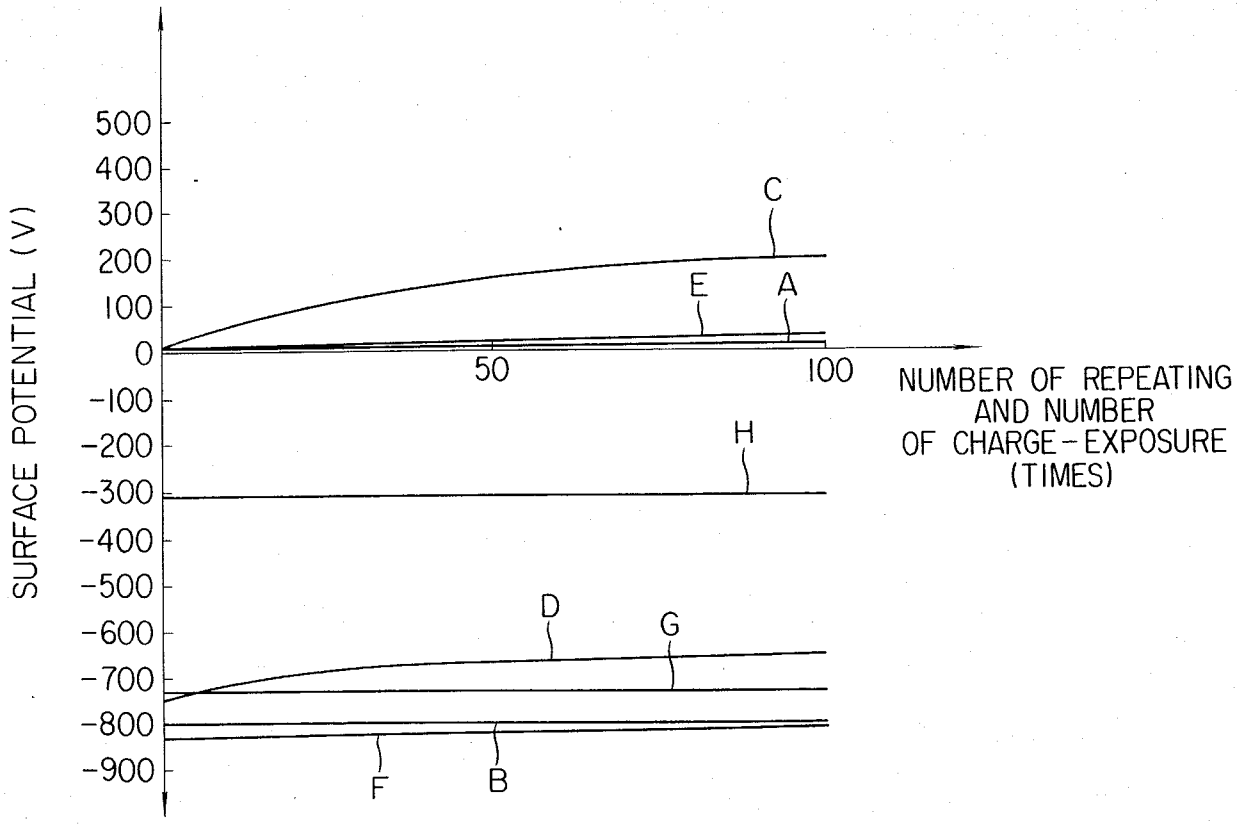
FIG. 6 is a graph showing the change of surface potentials when photosensitive members are used repeatedly.

When the doping amount of oxygen was 20 ppm in Example 1, a residual potential was hardly observed as shown by a straight line E of FIG. 6. When the doping amount of oxygen was 3000 ppm, 8000 ppm or 10,000 ppm, the result was the same as that when it was 1000 ppm. When the doping amount of oxygen was 10,000 ppm, the photosensitive member was charged to only 200 V, but when it was 8000 ppm, the photosensitive member was charged to 450 V.

When a surface potential of a photosensitive member having an insulating layer formed on a photoconductive layer in the same manner as in Example 1 was measured, a change of the surface potential was hardly observed as shown by a straight line F in FIG. 6 when the doping amount of oxygen was 20 ppm.

When the doping amount of oxygen was 3000 ppm, any change in the surface potential was not observed as shown by a straight line G. When the doping amount of oxygen was 10,000 ppm, any change of the surface potential was not observed as shown by a straight line H, but the photosensitive member had a low charge acceptance so that the photosensitive member was found to be impractical.

EXAMPLE 3

In a way similar to Example 1, a selenium layer doped with 1000 ppm of oxygen was produced in the thickness of 60 microns, and an Se-Te alloy containing 25% by weight of Te was deposited in the thickness of 1 micron. The photosensitive member thus produced was evaluated with respect to fatigue due to repeating as shown below. A positive corona discharging of ⊕ 6 KV was applied to charge to ⊕ 540 V immediately followed by a blanket exposure at 1.0 lux·sec, and then, discharging was effected by AC corona discharging. The above procedure was repeated 100 times at a cycle of 2 sec. The surface potential from the first time to the 100th time did not change and any fatigue due to repeating was not observed. The surface potential was 30 V.

COMPARATIVE EXAMPLE 2

Repeating the procedures in Example 3 except that a selenium of 99.999% in purity was vapor-deposited in place of a selenium doped with 1000 ppm of oxygen, the surface potential at the first time was 50 V, but the surface potential after a blanket exposure gradually increased with the number of times of repeating and became as high as 250 V at the 100th time to reveal a fatigue due to repeating.

EXAMPLE 4

In a way similar to Example 1, a selenium layer doped with 1000 ppm of oxygen was formed in the thickness of 60 microns and then an Se-Te alloy containing 35% by weight of Te was vapor-deposited thereon to form an SeTe layer in the thickness of 1 micron. Further, the resulting photoconductive layer was coated with a polyurethane as an insulating layer in the thickness of 25 microns. The resulting photosensitive member was evaluated with respect to a fatigue due to repeating as shown below.

A negative corona discharging of ⊖ 6 KV was effected to charge the surface of the photosensitive member to ⊖ 2000 V and a positive corona discharging of ⊕ 6 KV was conducted as a secondary charging followed by a blanket exposure resulting in a surface potential of ⊖ 700 V. The above procedure was repeated 100 times at a cycle of 2 sec. Any change in the surface potential from the first time to the 100th time was not observed and a fatigue due to repeating did not occur. At the 101st time a secondary charging was effected simultaneously with exposure at 1.0 lux·sec, and after a blanket exposure, the surface potential was ⊖ 50 V.

COMPARATIVE EXAMPLE 3

The procedure of Example 4 was repeated except that a selenium of 99.999% in purity was vapor-deposited in place of a selenium doped with 1000 ppm of oxygen. The photosensitive member thus produced was evaluated with respect to a fatigue due to repeating in a way similar to Example 4, that is, a negative corona discharging of ⊖ 6 KV was effected to charge the surface to ⊖ 2000 V, and a positive corona discharging of ⊕ 6 KV was effected as a secondary charging followed by a blanket exposure resulting in a surface potential of ⊖ 650 V. The above procedure was repeated 100 times at a cycle of 2 sec. The surface potential after a blanket exposure was gradually lowered and a fatigue due to repeating occurred. The surface potential at the 100th time was ⊖ 480 V.

At the 101st time, a secondary charging was effected simultaneously with exposure at 1.0 lux·sec, and after a blanket exposure, the surface potential was ⊖ 220 V.

What we claim is:

1. An electrophotographic photosensitive member free from fatigue due to repeated use which consists essentially of a photoconductive layer comprising selenium or a selenium alloy and containing doped oxygen in an effective amount up to 8000 ppm or less based on selenium and being prepared by vapor depositing a member selected from the group consisting of selenium or a selenium alloy, said member having oxygen doped therein.

2. An electrophotographic photosensitive member according to claim 1 in which the amount of oxygen is 20–8000 ppm.

3. An electrophotographic photosensitive member according to claim 1 in which an insulating layer is disposed on said photoconductive layer.

* * * * *